US006032385A

United States Patent [19]

Bischel et al.

[11] Patent Number: 6,032,385

[45] Date of Patent: Mar. 7, 2000

[54] METHOD FOR POCKET VENTILATION AND SHEET SUPPORT IN A PAPERMAKING MACHINE DRYER SECTION

[75] Inventors: Kevin H. Bischel, South Beloit, Ill.; Thomas K. Grunder, Beloit, Wis.

[73] Assignee: Beloit Technologies, Inc., Wilmington, Del.

[21] Appl. No.: 09/156,108

[22] Filed: Sep. 18, 1998

Related U.S. Application Data

[62] Division of application No. 08/789,971, Jan. 31, 1997, Pat. No. 5,887,358.

[51] Int. Cl.[7] ..... F26B 3/00; D21F 5/00

[52] U.S. Cl. ..... 34/456; 34/458; 34/457

[58] Field of Search ..... 34/453, 454, 455, 34/456, 457, 458, 115, 117, 120

[56] References Cited

U.S. PATENT DOCUMENTS

| | | | |
|---|---|---|---|
| 4,539,762 | 9/1985 | Eskelinen et al. | 34/114 |
| 4,669,198 | 6/1987 | Wedel | 34/456 |
| 4,953,297 | 9/1990 | Eskelinen et al. | 34/457 |
| 5,068,980 | 12/1991 | Müeller | 34/117 |
| 5,152,078 | 10/1992 | Wedel | 34/115 |
| 5,230,168 | 7/1993 | Heinzmann et al. | 34/117 |
| 5,495,679 | 3/1996 | Deshpande et al. | 34/117 |
| 5,524,360 | 6/1996 | Virta et al. | 34/457 |
| 5,737,848 | 4/1998 | Chau-Huu et al. | 34/114 |

*Primary Examiner*—Stephen Gravini

[57] ABSTRACT

A dryer section in a papermaking machine has two reversing rolls to form a pocket between each pair of dryers in a dryer tier. The first reversing roll is a vacuum roll and the second reversing roll is a grooved roll. A blow box is disposed between the two rolls, the blow box provides suction for the grooved roll and provides vacuum which restrains a web on the dryer fabric as it travels between the first and the second rolls. The blow box also provides a supply of make-up air which extends in a cross machine direction along the pocket formed by the two reversing rolls. The blow box also supports a pivoting foil which is positioned against the dryer fabric as it moves from a first dryer, towards the first reversing roll. The foil defines a region of low pressure which restrains the web as it travels between the first dryer and the first reversing roll.

1 Claim, 3 Drawing Sheets

METHOD FOR POCKET VENTILATION AND SHEET SUPPORT IN A PAPERMAKING MACHINE DRYER SECTION

CROSS REFERENCES TO RELATED APPLICATIONS

This application is a divisional of Application No. 08/789,971, filed Jan. 31, 1997 now U.S. Pat. No. 5,887,358, the disclosure of which is incorporated by reference herein.

STATEMENT AS TO RIGHTS TO INVENTIONS MADE UNDER FEDERALLY SPONSORED RESEARCH AND DEVELOPMENT

BACKGROUND OF THE INVENTION

The present invention relates to papermaking machines in general, and to the dryer section of a papermaking machine in particular.

In the papermaking process, a paper web is dried by first having excess water pressed from the web as it is transferred on a support felt through nips formed between press rolls in a press section. The paper web is then threaded from the press section to a dryer section where the web is dried as it passes over a series of heated dryer rolls. The web is backed by a porous felt or dryer fabric as it passes over the dryer rolls. In one conventional approach, a single vacuum guide roll is placed between successive dryer rolls in a tier. The felt-supported paper web travels in a serpentine fashion over the first dryer roll, then over the guide roll, then over a second dryer roll to a second guide roll, and so on through the dryer section. The dryer fabric is positioned between the vacuum roll and the web as it moves from one dryer roll to the next, and the reduced pressure drawn on the dryer fabric by the vacuum roll holds the web to the dryer fabric. Due to high web speeds, which in certain applications reach rates of up to 6,000 feet per minute or more, the web may flutter on the felt as it travels between a dryer roll and a vacuum guide roll. This flutter, which can be attributed to disruptive localized pressure generated along the traveling web, detrimentally affects the quality of the paper web produced and can result in web breaks. Breakage of the web being formed results in undesirable machine shut down and lost efficiency while the papermaking machine is being threaded and restarted.

In response to increased web speeds, attempts have been made to both prevent the web from fluttering on the support felt, and to efficiently maximize the drying of the web at the dryer section. Creating a vacuum in a "pocket" formed between two adjacent dryer rolls and the guide roll between them has been helpful in holding the paper web against the felt as it travels between dryer rolls and guide rolls. For example, a vacuum is formed within the pocket by creating a sealing ledge positioned above the guide roll and between two dryer rolls, so that air flow induced on the first dryer roll by the rapidly moving web is deflected to pass up and away from the pocket. Since the felt is permeable, the lower pressure inside the pocket pulls the web against the support felt, thereby preventing flutter.

By using two grooved guide rolls between adjacent dryer rolls, as in U.S. Pat. No. 5,495,679, the disclosure of which is incorporated by reference herein, dryer efficiency can be improved. Two rolls within the pocket allow a greater fraction of each dryer roll to be wrapped by the web, and hence allows greater drying to take place on each dryer roll. The two pocket rolls may be provided with circumferential grooves and enclosed within a box. Drawing a vacuum on the box not only holds the dryer fabric and the web to the grooved rolls, but also retains the web on the dryer fabric as it extends between rolls. The air drawn out of the pocket by the vacuum box or vacuum roll must be replaced. Typically the required make-up air is drawn in exclusively at the front and back sides of the papermaking machine. A papermaking machine can be 200 to 400 inches wide, and thus a rapid inflow of make-up air from the sides can generate turbulence which disrupts the web edges and compromises runnability and paper quality.

What is needed is an apparatus for ventilating the pocket in a paper machine drying section while providing support for the moving web as it travels between dryer rolls.

SUMMARY OF THE INVENTION

The apparatus of the present invention consists of a dryer section in a papermaking machine which employs two reversing rolls which form a pocket between each pair of dryers in a tier of dryers. The first reversing roll is a vacuum roll and the second reversing roll is a grooved roll. A blow box is disposed between the two rolls, the blow box provides suction for the grooved roll and for the dryer fabric as it travels between the first and the second rolls. The blow box also provides a supply of make-up air which extends in a cross machine direction along the pocket formed by the two reversing rolls. The make-up air thus supplied prevents an inrush of air from the machine ends. The blow box supports a pivoting foil which is positioned against the dryer fabric as it moves from a first dryer, towards the first reversing roll. The foil separates the boundary layer of air from the dryer fabric as it enters the pocket formed by the reversing rolls. The foil defines a region of low pressure. The low pressure is caused by the foil deflecting the boundary layer and by the vacuum provided by the first reversing roll. Thus the two reversing rolls and the blow box with attached foil provide a means for drawing the paper web against the drying fabric as the web moves between adjacent dryer rolls.

It is a feature of the present invention to provide an apparatus that both efficiently ventilates a pocket and dries a paper web in a papermaking machine dryer section.

It is also a feature of the present invention to provide a method for introducing vacuum pocket make-up air all across the pocket in a papermaking machine dryer section.

It is another feature of the present invention to provide an apparatus that holds a paper web to a support felt as it travels between dryer rolls in a dryer section.

It is yet another feature of the present invention to provide a web transfer mechanism between dryer rolls that can accommodate paper wads that accumulate and travel around a dryer roll.

Further objects, features and advantages of the invention will be apparent from the following detailed description when taken in conjunction with the accompanying drawings.

DESCRIPTION OF THE PREFERRED EMBODIMENT

Figure 1:
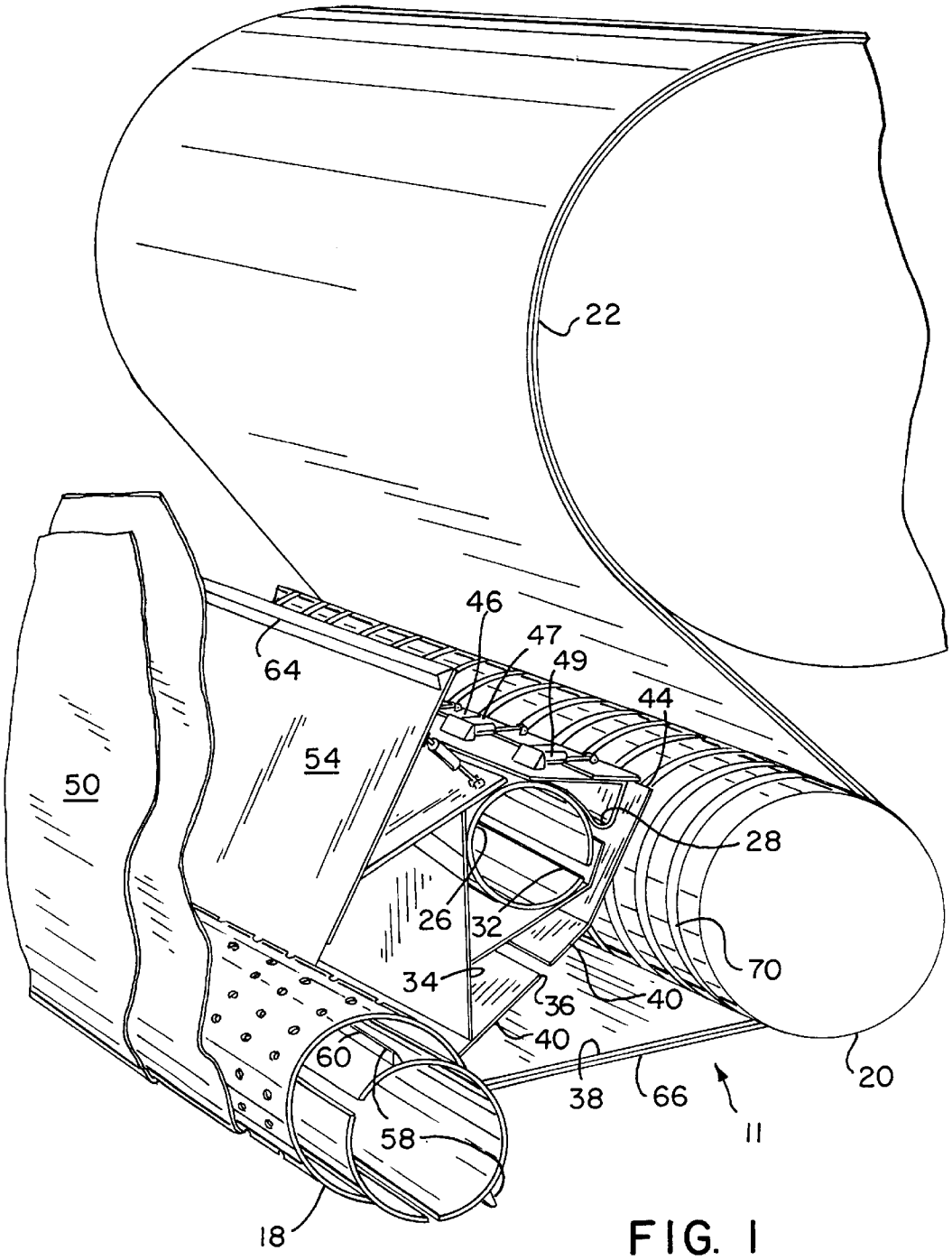
FIG. 1 is an illustrative perspective view, not to scale, and partially broken away in section of a portion of a papermaking machine dryer section of the present invention.
Figure 2:
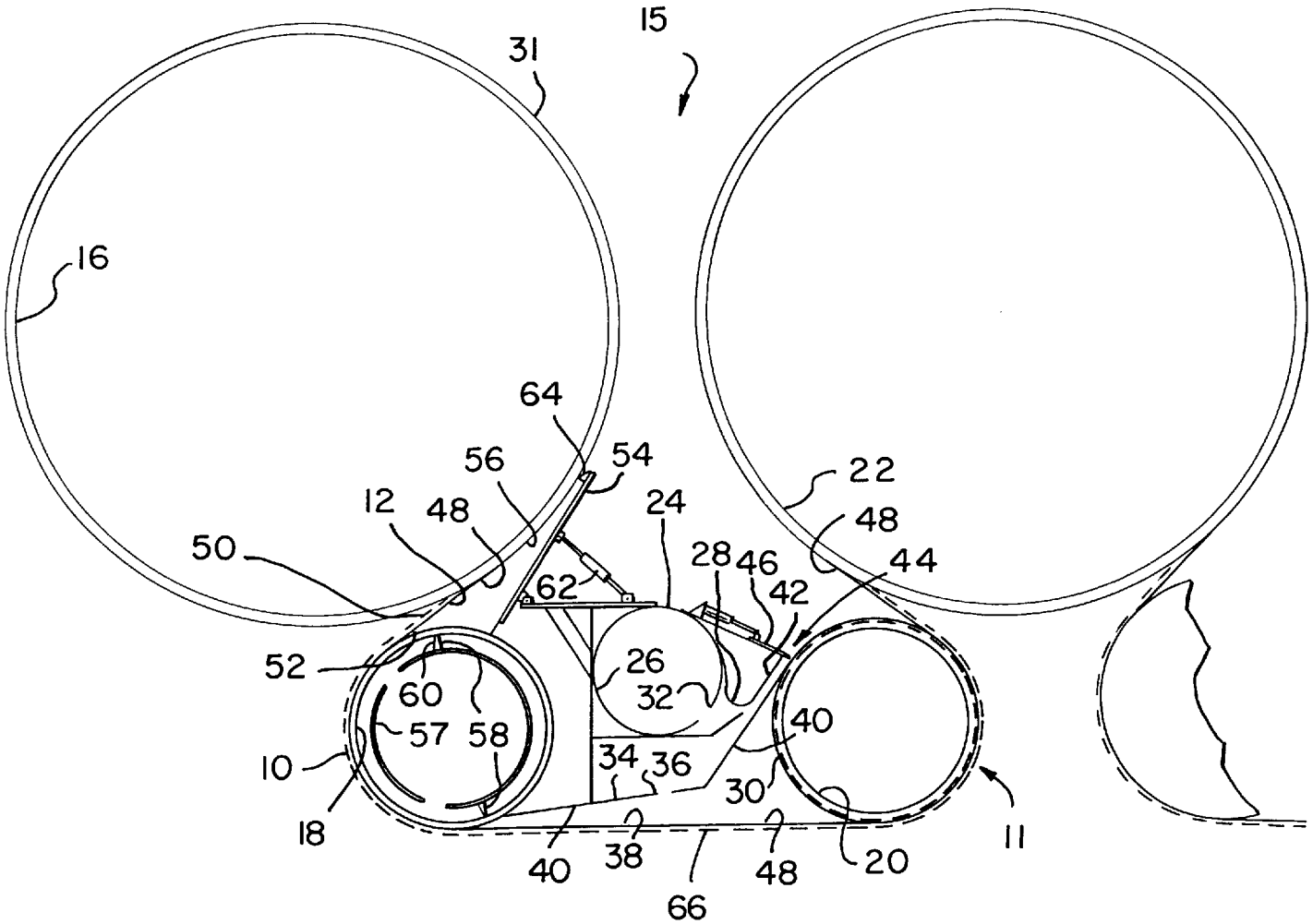
FIG. 2 is a cross-sectional view of a portion of the dryer section of FIG. 1 taken along section line 2—2.
Figure 3:
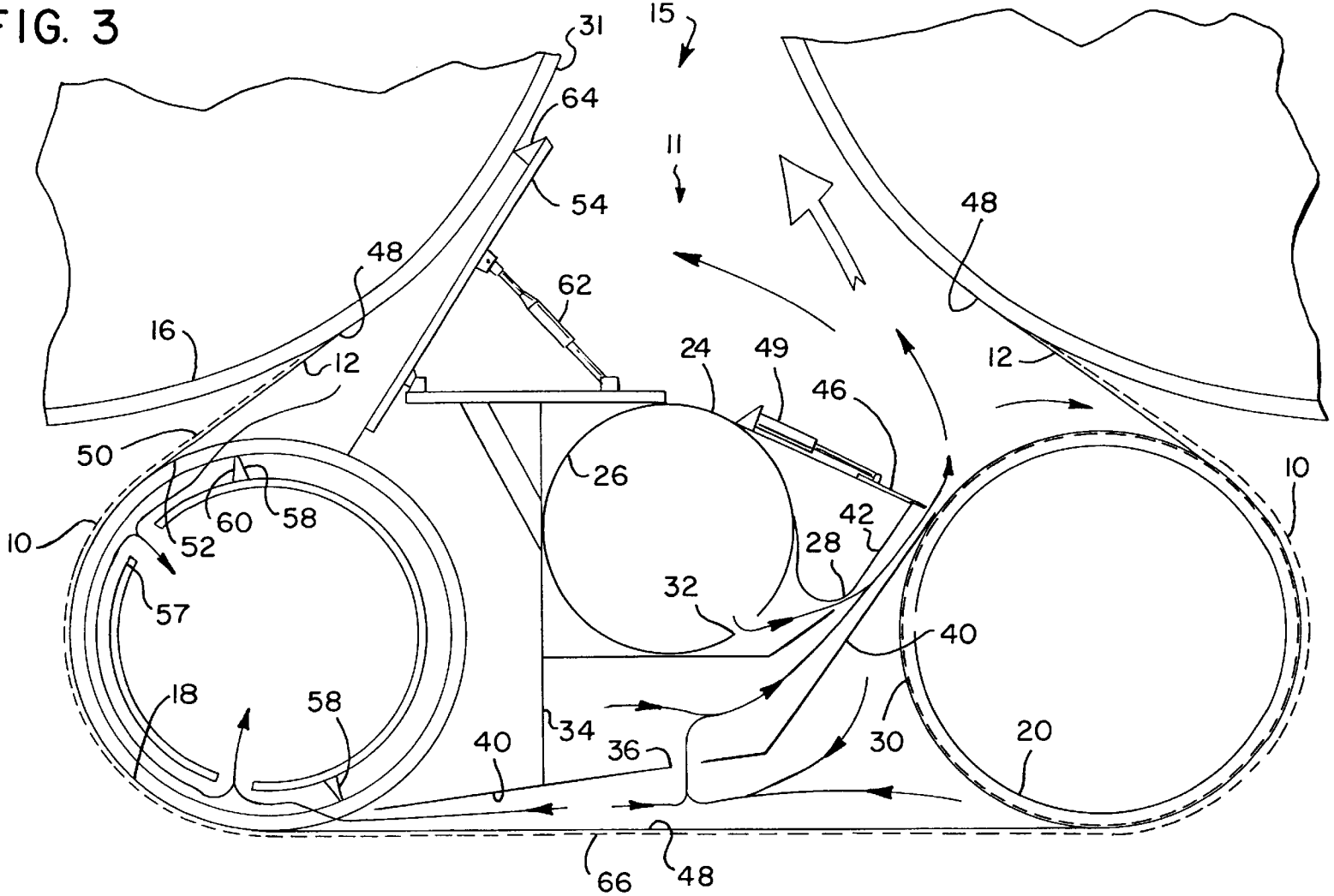
FIG. 3 is a schematic view showing the generated air paths of the apparatus of FIG. 2.

Referring more particularly to FIGS. 1–3, wherein like numbers refer to similar parts, the pocket ventilation and sheet support system 11 of the present invention is shown in FIGS. 1–3. When drying a paper web 10 in a papermaking machine, the paper web 10 is supported on a permeable support felt or dryer fabric 12 that travels along a series of dryer rolls 16, 22 in a dryer section 15.

In a modern highspeed papermaking machine it is desirable that the paper web be constrained at all times as it traverses the dryer section. Web constraint prevents wrinkling of the web and breakage of the web due to sheet flutter. Constraining the web also reduces paper shrinkage which improves paper quality by reducing the tendency of the formed paper to curl. Because of the high speed of a modern papermaking machine, up to 6,000 feet per minute or more, low drying rates can require undesirably long dryer sections. To keep the dryer section of manageable length at high papermaking speeds, it is desirable to increase the amount of drying per unit length of the dryer section. This can be accomplished by increasing the proportion of each dryer roll's surface which is wrapped by the web. Increased drying can also be effected by ventilating the web as it passes between dryers, and by adding supplemental heat to the web with by the use of high velocity, high temperature air impingement hoods such as those manufactured by Beloit Corporation of Beloit, Wis., under the name Air Cap™ dryers, or with infrared heaters.

The web 10 is constrained while passing over the dryer rolls 16, 22 by a dryer fabric 12. The dryer fabric is permeable so water vapor can pass through the fabric 12 as the web is dried on the dryer roll surfaces. Between the dryer rolls 16, 22 the web is constrained by applying a vacuum to the side 31 of the dryer fabric 12 which faces away from the web 10. Typically this is accomplished with a single vacuum roll positioned between adjacent dryer rolls.

A vacuum roll is a cylindrical roll the surface of which is punctured by an array of holes. A nonrotating gland within the vacuum roll draws air through the holes over that portion of the roll on which the dryer fabric is wrapped. The dryer section 15 increases the portion of the circumference of the dryer rolls which is wrapped by the web and the dryer fabric 12 by using two reversing rolls 18, 20. Vacuum rolls, however, are expensive because of the cost of drilling the multitude of holes necessary for their function. Grooved rolls are less expensive to purchase and operate but require a source of vacuum which draws air through the grooves and thus through the dryer fabric as it passes over the grooved roll. Typically a vacuum box is employed with a grooved roll.

The dryer section 15 employs a blow box 24 which is positioned between the vacuum roll 18 and the grooved roll 20. The blow box 24 utilizes pressurized air supplied from a cylindrical duct 26 which utilizes an aerodynamic effect produced by a venturi type nozzle 28 to draw air from the back side 30 of the grooved roll 20. The cylindrical duct 26 has a machine direction slot 32 which supplies air to a nozzle 28 which aspirates air from a baffle chamber 34. The baffle chamber 34 in turn has a cross machine direction distribution slot 36 which draws air from a chamber 38 formed by a baffle plate 40 the dryer fabric (which passes between the vacuum roll 18 and the grooved roll 20) and the back of the grooved roll 30.

The blow box nozzle 28 blows up through a nozzle extension 42 formed between the baffle plate 40 and an upper nozzle plate 42. The air from the cylindrical duct 26 exits through a plurality of holes 44 which extend in the cross machine direction. The width of the holes is controlled by an adjustable baffle 46 which is composed of individual segments 47. The segments 47 are positioned by pneumatic or screw actuators 49 which control the cross machine direction distribution of make-up air. The baffle segments 47 may be adjustable either manually or automatically so that the amount of air passing through the distribution holes 44 is varied in the cross machine direction.

Use of a blow box instead a vacuum box provides several distinct advantages. First, wherever a vacuum roll is used in a pocket, air is removed from the immediate vicinity of the roll. Thus when a vacuum roll is used in a pocket 48 formed by reversing rolls between dryers, air must be supplied to make up for the air removed by the vacuum roll 18. The blow box can supply the make-up air uniformly along the pocket 48 in the cross machine direction. The adjustable baffle 46 allows the amount of make-up air to be matched to the local vacuum.

Blow boxes are also cheaper to operate then vacuum boxes. The blowers for the vacuum boxes must be larger then the blowers for a blow box because the air in a vacuum blower is handled at a lower pressure.

One area of concern which often produces destructive flutter in a paper web being dried is the region 50 between where the web 10 leaves the dryer roll 16 and the line 52 where the web wraps onto the vacuum roll 18. The back 31 of the dryer fabric 12 entrains a boundary layer of air which can become trapped between the vacuum roll 18 and the fabric 12 causing air to pass through the fabric and blow the web off the fabric. This is prevented by a hinged foil or baffle 54 which strips the boundary layer from the back 31 of the dryer fabric 12. The hinged baffle 54 forms a region 56 from which air may be drawn by the vacuum roll 18. The vacuum roll contains a gland 57 within the roll 18 which employs wipers 58 which control that portion of the vacuum roll 18 from which air is drawn. The upper wiper 60 is positioned so that air is drawn from the region 56. The low pressure in the region 56 prevents air from being blown through the fabric 12, and instead causes air to be drawn through the web 10 and the dryer fabric 12 thus restraining the web on the fabric.

The hinged baffle 54 is supported by a pneumatic strut 62 which allows the baffle 54 to pivot away from the dryer roll 16 should a wad of paper travel around the dryer roll 16. The baffle 54 is also responsive to the paper web becoming wrapped around the dryer roll 16. Often when a paper break occurs the broken web winds around a dryer until the papermaking machine can be stopped in response to the detected web break. A small felt wedge 64 is positioned on the end of the baffle 54 closely engaging the dryer roll 16. The felt 64 facilitates the baffle 54 sealing against the dryer fabric 12.

It should be understood that the individual segments 47 of the baffle plate 46 function as guillotine valves and that the holes 44 may be circular or may be oblong with their long axis extending in the cross machine direction.

It should be understood that the portion 66 of the web 10 which travels between the vacuum roll 18 and the grooved roll 20 may be dried with external drying equipment such as an air cap, steam box or infrared heating unit.

It is understood that the invention is not limited to the particular construction and arrangement of parts herein illustrated and described, but embraces such modified forms thereof as come within the scope of the following claims.

We claim:

1. A method of ventilating a pocket in a papermaking machine dryer section, the pocket being formed as a dryer fabric travels between a first dryer roll, to a vacuum roll, and from the vacuum roll to a grooved roll, and from the grooved roll to a second dryer roll, the method comprising the steps of:

generating a first region of lower air pressure in a space defined by a portion of the dryer fabric which extends between the first dryer roll and the vacuum roll, and a pivoting foil mounted between the vacuum roll and engaging the dryer fabric on the first dryer roll;

channeling boundary layer air attached to the dryer fabric away from the fabric by positioning a first edge of the pivoting foil against the dryer fabric as it moves toward the first region of lower air pressure;

injecting make-up air into the pocket from a blow box, the blow box extending in the cross-machine direction and having adjustable dampers for controlling the flow of the make-up air and the profiling the flow of make-up air in the cross-machine direction; and using the blow box to generate a region of lower air pressure, by passing air through a diverging nozzle, the region supplying lower pressure air to the dryer fabric as it passes between the vacuum roll and the grooved roll, and further applying the region of lower pressure air to a portion of the grooved roll so that air is drawn out of the grooves.

* * * * *